United States Patent [19]

Booth

[11] Patent Number: 4,527,983

[45] Date of Patent: Jul. 9, 1985

[54] TROLLING CONTROL FOR BOATS

[76] Inventor: Jerry N. Booth, 8176 Fewtown Rd., Atwater, Ohio 44201

[21] Appl. No.: 517,722

[22] Filed: Jul. 27, 1983

[51] Int. Cl.[3] ..... B63H 21/26

[52] U.S. Cl. ..... 440/7; 74/478; 74/480 B; 74/512; 114/153

[58] Field of Search ..... 440/7, 6; 114/144 A, 114/153; 74/478, 480 B, 481, 512, 560

[56] References Cited

U.S. PATENT DOCUMENTS

| | | | |
|---|---|---|---|
| 2,804,838 | 9/1957 | Moser | 440/7 |
| 2,865,223 | 12/1958 | Kope | 74/478 |
| 2,961,986 | 11/1960 | Rockhill | 74/480 B |
| 2,985,031 | 5/1961 | Bennett | 74/512 |
| 3,417,723 | 12/1968 | Abermanis | 74/480 B |
| 3,511,208 | 5/1970 | Woodruff | 440/7 |
| 3,561,393 | 2/1971 | Fortson | 440/7 |
| 3,580,212 | 5/1971 | Fortson | 440/7 |
| 3,602,181 | 8/1971 | Harris | 440/7 |
| 3,995,579 | 12/1976 | Childre | 440/7 |
| 4,295,385 | 10/1981 | Huttenhow | 74/512 |
| 4,303,033 | 12/1981 | King | 440/6 |

*Primary Examiner*—Sherman D. Basinger

*Attorney, Agent, or Firm*—Michael Williams; Warren N. Low

[57] ABSTRACT

My invention provides a control for a trolling motor of a fishing boat, whereby both steering of the boat and operation of the motor may be controlled through use of but one foot of a fisherman. The control has a very low profile so that a standing person may operate the same with his foot in a position not too far displaced from a flat condition on the boat deck, whereby such person is balanced at all times and thus may devote full attention to fishing and little if any attention to maintaining balance. The control comprises a hollow box having center bearing for supporting a shaft in upright position. A foot plate is disposed exteriorly of the box and connected to the shaft, the construction being such that the shaft may be rotated by movement of the foot imparted to the foot plate and also depressed by downward pressure of the foot on the footplate. When the shaft is rotated, movement thereof is transmitted to mechanism which causes the trolling motor to swing in the water from side to side to cause steering of the boat. When the shaft is depressed, switch contacts are engaged to control flow of electrical energy to the motor.

10 Claims, 11 Drawing Figures

TROLLING CONTROL FOR BOATS

BACKGROUND AND SUMMARY

The prior art includes U.S. Pat. No. 3,511,208 issued May 12, 1920 to O. C. Woodruff and U.S. Pat. No. 4,295,385 issued Oct. 20, 1981 to G. H. Huttenhow which relate to the general subject matter of this invention.

Woodruff discloses an electric trolling motor that may be moved by a foot pedal to effect steering of the boat, and Huttenhow discloses a control for moving a trolling motor, the control having a low profile and including a rotatable plate adapted to be moved by the shoe of an operator.

The normal equipment on a fishing boat includes an outboard motor of substantial horsepower so that the boat may be driven to the fishing grounds as quickly as possible. The equipment also includes a battery for starting the motor, gasoline tanks and many items necessary for fishing and for the comfort of the fisherman.

With this amount of equipment, easy and effect manueverability of the boat becomes a problem, particularly when moving in and out of tight spots in the narrow confines of lake of stream. On the other hand, it is desirable that the fisherman have both hands free to concentrate on fishing and that he need not take his eyes off a likely fishing locality to locate steering and speed controls.

My invention provides the above desirable features in a simple foot control that may be mounted on a short deck at the bow of the boat and be engaged by the shoe of an operator to selectively effect both steering and operation of the trolling motor. Fishermen, particularly those fishing for bass, like to stand on the deck so as to have a clear view of the water for some distance around the boat. Heretofore a pedal-like control was provided for steering the boat, somewhat along the lines of an accelerator pedal on an automobile, except that the pedal was pivotally mounted on the deck at the bow of the boat. The pedal had an electric switch actuator extending from its upper surface and the fisherman was required to place his foot on the switch and then depress the pedal, and this was difficult to do in a standing position because the fisherman was completely off balance.

In contrast, the control of my invention has a very low profile so that the fisherman may operate it while fully balanced. Further, the control includes a footplate that is shiftably mounted and may be simultaneously depressed to actuate an electric switch within the control box.

DESCRIPTION OF THE DRAWINGS

In the drawings accompanying this specification and forming a part of this application, there are shown, for purpose of illustrations, several embodiments which my invention may assume and in these drawings.

DESCRIPTION OF THE PREFERRED EMBODIMENT

Figure 1:
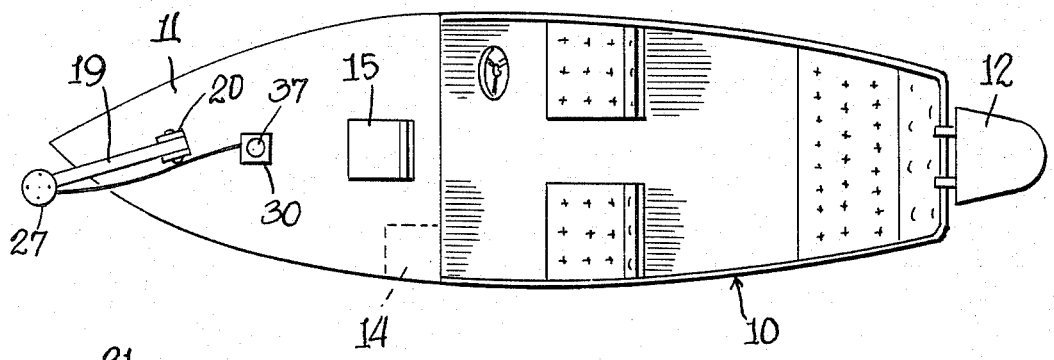
FIG. 1 is a top plan view of a boat wherein my invention is incorporated.
Figure 2:
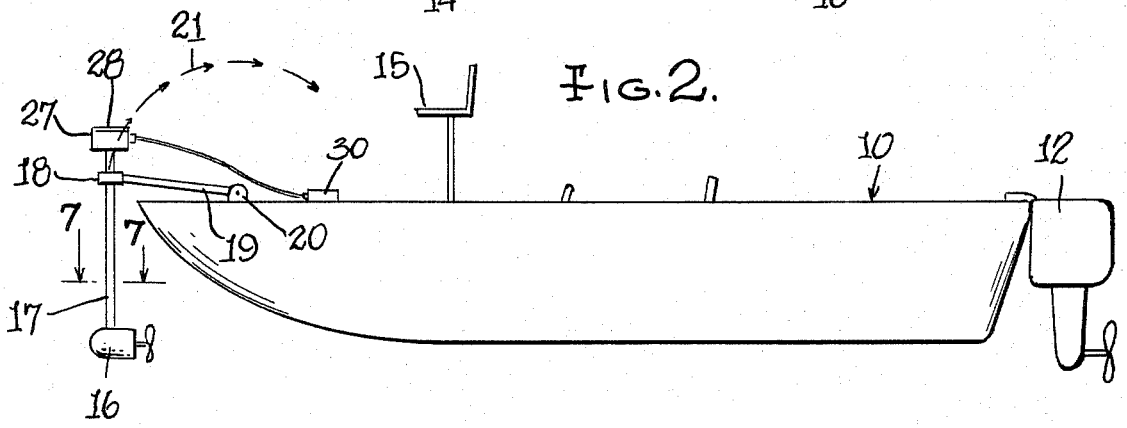
FIG. 2 is a side elevational view thereof.

FIGS. 1 and 2 illustrate a common type of fishing boat 10, having a deck 11 at the bow portion. The boat has a gasoline motor 12 at the stern, and this motor is of substantial horsepower in order to propel the boat at high speeds. The boat has the usual equipment, including a battery 14 for starting the motor 12. A seat 15 may be provided on the deck, but fishermen prefer to stand on the deck for a better view of the surroundings.

An electric motor 16 is carried at the bow of the boat and receives its power from the battery 14. The housing for the motor 16 is carried at the lower end of a tubular post 17, the upper end of which is connected, by clamp 18 (see FIG. 2) to the free end of an arm 19. The opposite end of the arm is pivoted between ears 20 which extend upwardly from the deck 11. The construction is such that the post 17 and motor 16 may be swung about the pivot for the arm 19 (as suggested by the arrows 21) to a position wherein motor and post lie on the deck 11. A hollow shaft 25 is journalled within the post 17 and is connected to the motor 16 at its lower end so that the motor may be swung about the axis of the post to effect steering of the boat. Wires 26 extend through the interior of shaft 25 to transmit electrical energy to the motor. A housing 27 is mounted on the upper extremity of the post 17, a cover 28 closing the upper end of the housing. Most of the foregoing is known in the prior art and disclosed in the aforesaid Woodruff patent.

Figure 4:
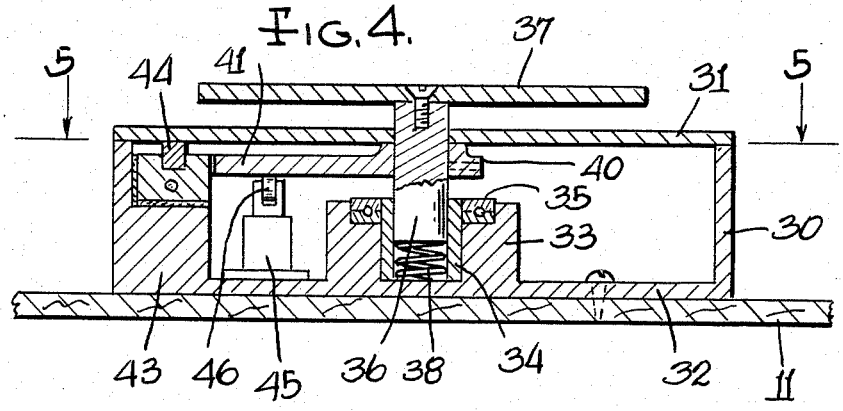
FIG. 4 is an enlarged sectional view corresponding to the line 4—4 of FIG. 3.

My improved device for controlling operation of the electric motor 16 and for swinging the motor to effect steering of the boat is contained within a box 30 which may be formed of suitable metal or plastic. The box preferably has a removable cover 31 to provide for access to the interior thereof. As seen in FIG. 4 the bottom 32 of the box may be lagged to the top surface of the deck 11. The box may be rectangular in plan and is very low in height, a height dimension not exceeding two inches (about 12.8 centimeters) being presently preferred.

Figure 3:
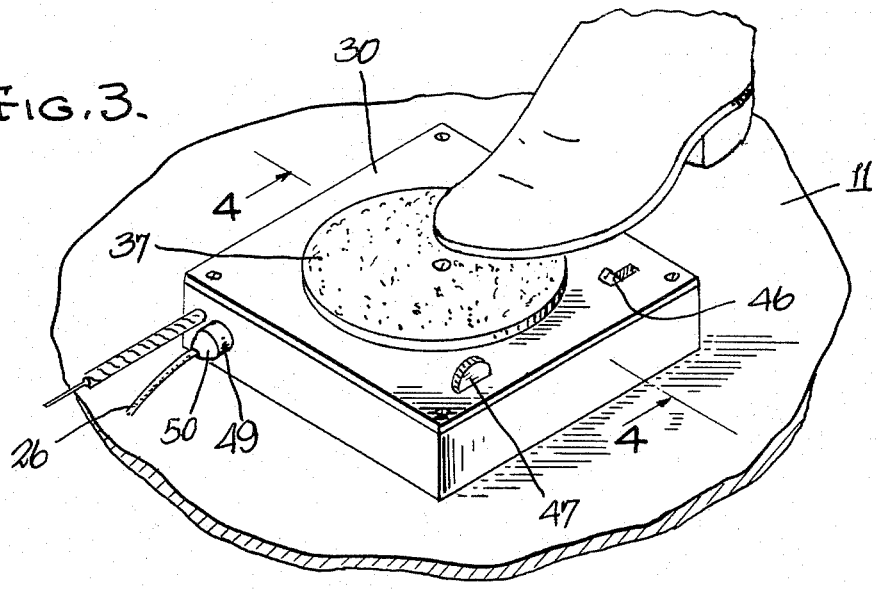
FIG. 3 is a perspective view of my control.

A post 33 extends upwardly from the bottom 32 of the box and contains a sleeve bearing 34 and a thrust bearing 35. A shaft 36 has its lower portion journalled within the sleeve bearing and has its upper end extending through a hole in the box cover 31. A plate 37 is connected to the upper end of the shaft and is preferably in the form of a disc with its upper surface roughened. As suggested in FIG. 3 the forward portion of the shoe of a fisherman may bear on the plate while the heel of the shoe may rest in the adjoining portion of the deck 11. As the shoe is rotated about the heel, the disc 37 will be rotated accordingly, and downward pressure applied to the disc will cause shaft 36 to move downwardly in the sleeve bearing, against the upward pressure exerted by a spring 38.

Secured to the shaft is the hub 40 of a gear sector 41, the latter meshing with a rack 42 which is slidably carried by a shoulder 43 within the box 30. A key 44, carried by the cover 31, is seated within an elongated slot in the rack to position the latter. Secured to and extending upwardly from the bottom 32 of the box is an electric switch 45 having a roller 46 on its actuator rod. When the disc 37 is depressed, the gear sector moves down accordingly and presses the switch actuator rod downward to effect operation of the switch 45. The gear sector may be simultaneously rotated and moved downwardly, the roller 46 providing for switch operation in any rotated position of the sector. The switch may be of an "on-off" type to make or break an electric circuit, or may be in the form of a rheostat to increase speed of the motor as the disc 37 is moved downwardly and to break the electrical circuit when the spring 38 has moved the shaft 36 to its upper limit.

The switch 45 may be in electric circuit with an "off-on" switch 46 (see FIG. 3) and with a speed selector switch having a rotator 47, both switches being operable by proper movement of the shoe of a fisherman. The wires from such electric cicruit terminate in a socket 49 (see FIG. 5) which is disposed exteriorly of the box 30 to receive a plug 50 at the end of the motor wires 26.

Figure 5:
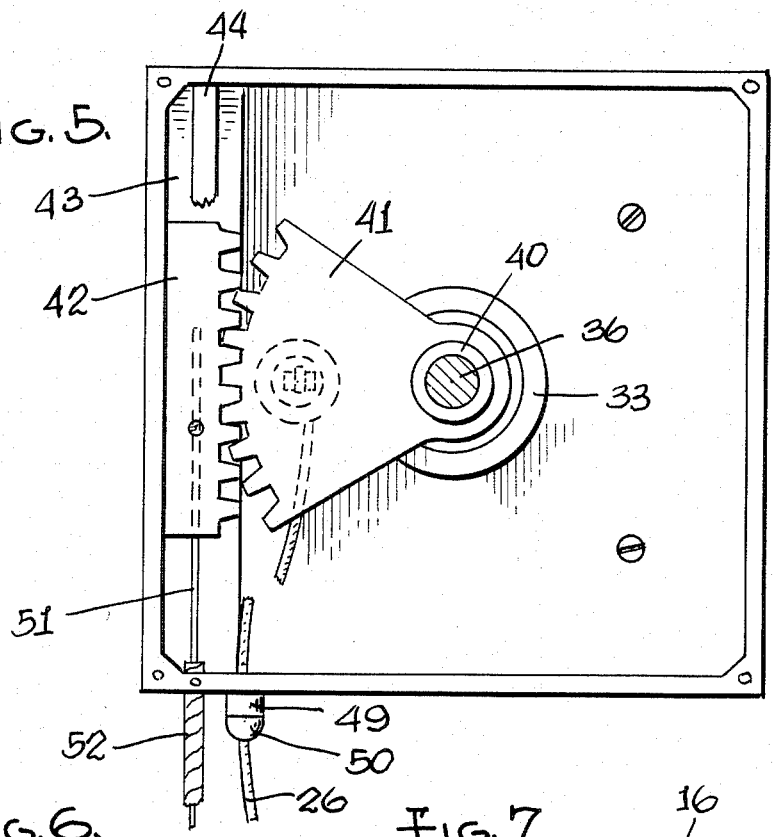
FIG. 5 is a sectional view corresponding to the line 5—5 of FIG. 4.
Figure 6:
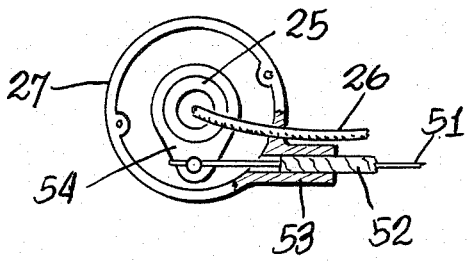
FIG. 6 is a top plan view of a detail, partly in section.
Figure 7:
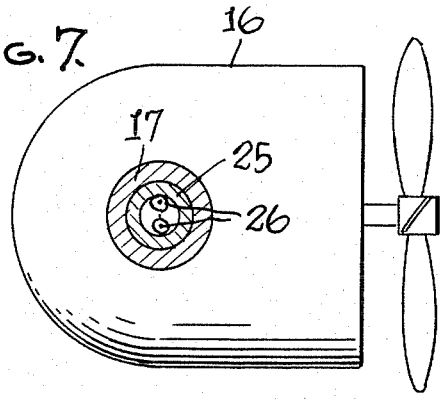
FIG. 7 is an enlarged sectional view corresponding to the line 7—7 of FIG. 2.

Attached to the rack 42 is the end of a stiff wire 51 (like a Bowden wire), the wire being adapted to be moved axially by the rack. The wire extends through a flexible metal tube 52 which has its end secured to the box, as shown in FIG. 5. The other end of the flexible tube (see FIG. 6) is attached to a sleeve 53 formed on the housing 27 and the wire 51 extends into the housing and is connected to a crank 54 fixed to the shaft 25 so as to rotate the latter when the wire is pushed or pulled by the gear rack 42. The crank 54 represents one way by which the shaft 25 may be rotated. Another way could be the rack and gear shown in said Woodruff patent.

DESCRIPTION OF OTHER EMBODIMENTS

Figure 8:
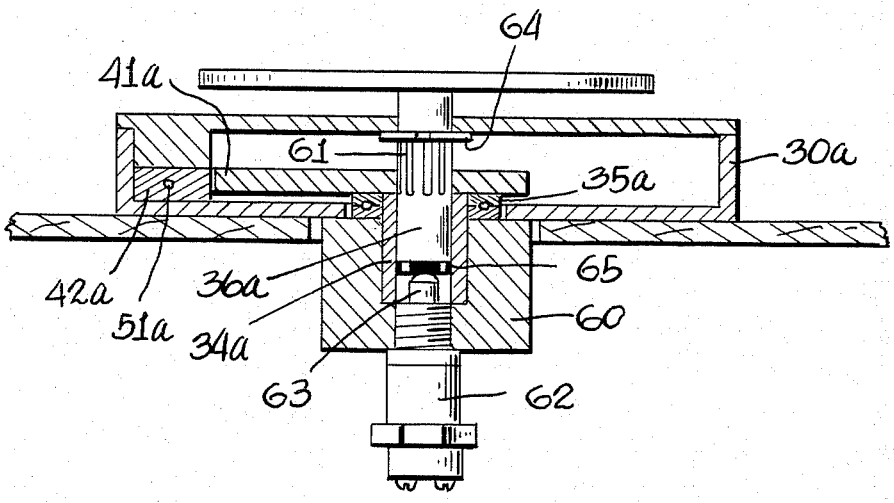
FIG. 8 is a sectional view, similar to FIG. 4 but showing a slightly different embodiment.

In FIG. 8 the box 30*a* has a depending housing 60 having an axial opening for receiving a sleeve bearing 34*a* and a thrust bearing 35*a*. The shaft 36*a* has a splined portion 61 so that the gear sector 41*a* may be rotated without being moved axially. This provides for an even lower profile for the box 30*a*. The gear sector meshes with a rack 42*a* which pushes or pulls the wire 51*a* for effecting steering action of the trolling motor 16.

An electric switch 62 has an end threaded into the lower end of the opening in the housing 60. The switch is of the type which has its operating plunger 63 spring-pressed outwardly and this action is used to push the shaft 36*a* to its upper position limited by a split washer 64. A nylon washer 65 may be interposed between the switch plunger 63 and the lower end of shaft 36*a* to reduce friction.

Figure 9:
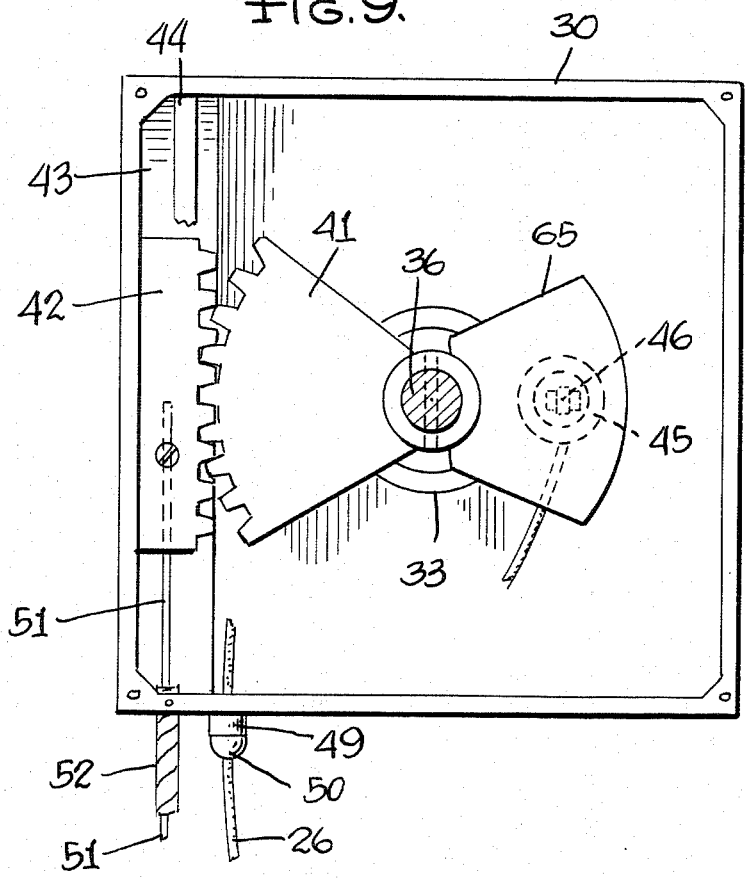
FIGS. 9, 10 and 11 are views similar to FIG. 5, each view showing a slightly different embodiment.

The construction in FIG. 9 is quite similar to that shown in FIG. 5 and like parts bear like reference numbers. In this case the gear sector 41 has a tail portion 65 to cooperate with the roller 46 on the switch 45.

Figure 10:
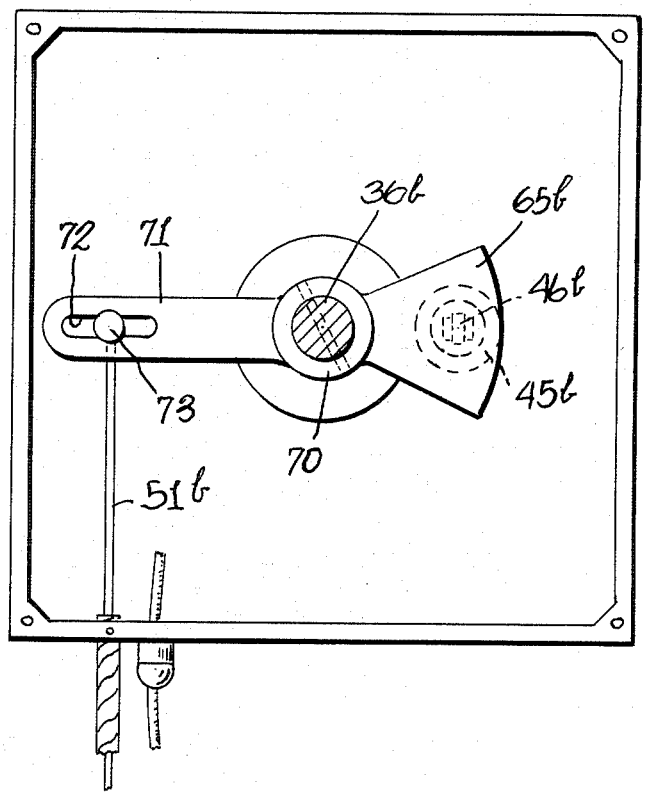
Figure 11:
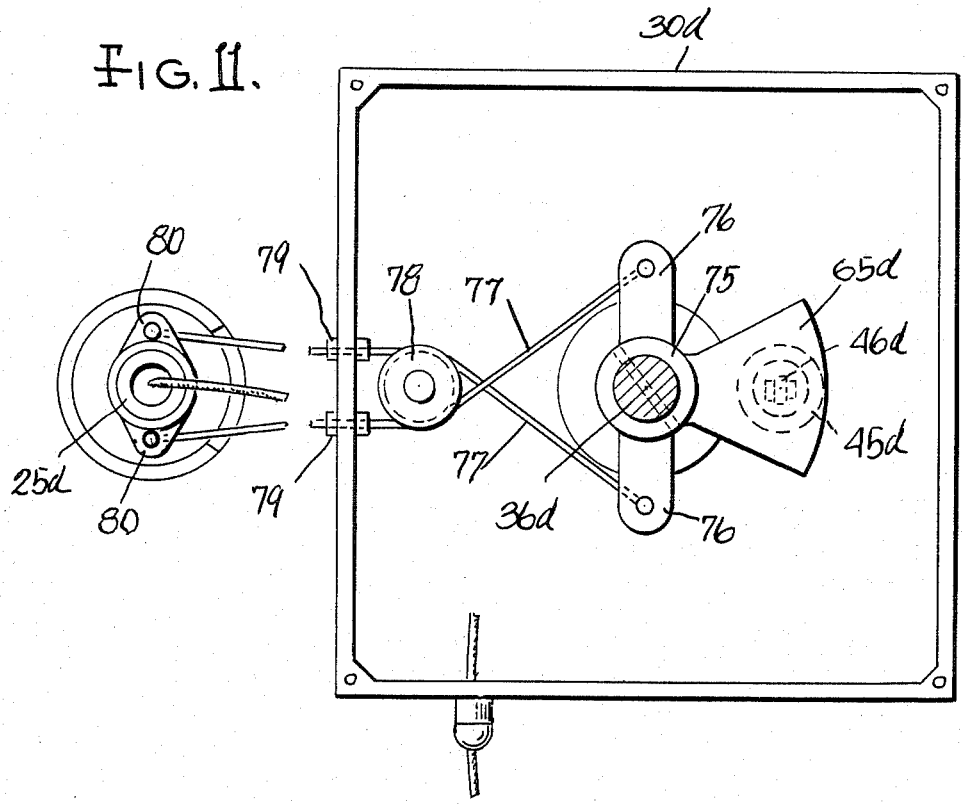

FIGS. 10 and 11 illustrate constructions wherein a gear sector and rack combination is not required. In FIG. 10, the shaft 36*b* has a collar 70 fixed thereto. A link 71 extends from one side of the collar and has an elongated opening 72 therein for slidably receiving a follower 73 attached to the end of the wire 51*b*. As the link 71 is rotated, the wire will be pushed or pulled accordingly to effect steering action of the trolling motor. A tail 65*b* extends from the opposite side of the collar for cooperation with the roller actuator 46*b* of the electric switch 45*b*.

In FIG. 11 a collar 75 is attached to the shaft 36*d* and link sections 76 extend from opposite sides of the collar and a tail portion 65*d* extends rearwardly between such sections. The tail portion is adapted to cooperate with the roller actuator 46*d* of an electric switch 45*d* for a purpose such as described before.

The ends of flexible cables 77 are connected to respective link sections 76 and the cables extend over an idler roller 78 and through bearings 79 in a wall of the box 30*d* and to respective crank arms 80 connected to the motor tube 25*d*.

I claim:

1. A control for a trolling motor which is swingably mounted on a boat for the purpose of steering the latter, comprising:

shaft and bearing means securable to the said boat, said shaft mounted in said bearing for rotary movement and additionally mounted therein for movement in a direction along the axis of said shaft, a generally planar plate secured to said shaft for rotary movement therewith in the plane of the plate and also movement transverse to said rotary movement along the axis of said shaft, means effected by rotary movement of said plate to cause swinging movement of said motor and consequent steering operation of said motor, and a switching device controlling said motor having an operator member arranged to effect operation of said switching device when said plate is moved in a direction along the axis of said shaft to thereby effect operation of said trolling motor to propel said boat.

2. A control for a trolling motor which is swingably mounted on a boat for the purpose of steering the latter, comprising:

a support disposed on said boat and having a bearing, a shaft journalled within said bearing for rotation and also movable axially within said bearing, means effected by rotation of said shaft to cause swinging movement of said trolling motor and consequent steering of said boat, and a switching device having an operator member arranged to effect operation of said switching device when said shaft is moved axially within said bearing in a predetermined direction to thereby effect operation of said trolling motor to propel said boat.

3. A control for an electric trolling motor which has its housing rotatably mounted on a boat for the purpose of steering the latter, and a battery for supplying electrical energy to said motor for the purpose of propelling said boat, comprising:

a box adapted to be supported on the boat, said box having a sleeve bearing extending from a surface thereof, a shaft journalled within said sleeve bearing for rotation and also movable axially within said sleeve bearing, means effected by rotation of said shaft to cause rotation of said motor housing and consequent steering of said boat, and an electric switch for controlling electrical energy from said battery to said motor, said electric switch having an operator member arranged to effect operation of said switch when said shaft is moved axially within said sleeve bearing in a predetermined direction to thereby energize said motor to propel said boat.

4. The construction according to claim 3 and further including a plate mounted on said shaft, said plate being adapted for operation by the foot of a person for rotating or axially moving said shaft.

5. The construction according to claim 4 wherein said means affected by rotation of said shaft includes a gear sector rotatable with said shaft, and a gear rack meshing with said sector and movable axially through rotation of the latter.

6. The construction according to claim 5 wherein said gear sector is connected to said shaft to be moved axially therewith, and said operator member of said electric switch is moved axially of the latter to effect switching operation, said operator member having a roller and the latter having rolling contact with said gear sector so that the latter may depress said operator member in any rotated position of said gear sector.

7. The construction according to claim 6 wherein said gear sector is provided with a tail portion and the roller of said operator member has rolling contact with said tail portion.

8. The construction according to claim 5 wherein said shaft has a splined portion and said gear sector has a splined opening cooperable with said shaft portion so that said shaft rotates said gear sector but may move axially without axially moving said gear sector, said switch operator member being engageable with an adjoining end of said shaft and moveable by axial movement of said shaft.

9. The construction according to claim 4 wherein said means affected by rotation of said shaft includes a link secured to said shaft for rotation and axial movement therewith, said link having an elongated slot for receiving the slider end of a push-pull wire.

10. The construction according to claim 4 wherein said means affected by rotation of said shaft includes diametrically opposed links secured to said shaft for rotation and axial movement therewith, and a cable attached to each link and arranged so that a pulling force is applied to a respective cable through predetermined rotation of said shaft.

* * * * *